US006611660B1

(12) United States Patent
Sagal

(10) Patent No.: US 6,611,660 B1
(45) Date of Patent: Aug. 26, 2003

(54) RADIAL FIN THERMAL TRANSFER ELEMENT AND METHOD OF MANUFACTURING SAME

(75) Inventor: E. Mikhail Sagal, Warwick, RI (US)

(73) Assignee: Cool Options, Inc. a New Hampshire corp., Warwick, RI (US)

( * ) Notice: Subject to any disclaimer, the term of this patent is extended or adjusted under 35 U.S.C. 154(b) by 0 days.

(21) Appl. No.: 10/135,743

(22) Filed: Apr. 30, 2002

(51) Int. Cl.[7] ..... H05D 3/78
(52) U.S. Cl. ..... 392/497; 392/503; 219/546
(58) Field of Search ..... 392/800, 801, 392/503; 219/546, 548, 552, 553, 540

(56) References Cited

U.S. PATENT DOCUMENTS

| | | | | | |
|---|---|---|---|---|---|
| 2,146,402 | A | * | 2/1939 | Morgan | 219/542 |
| 2,719,354 | A | | 10/1955 | Dalin | 165/185 |
| 3,621,566 | A | * | 11/1971 | Welsh | 29/610.1 |
| 4,356,864 | A | | 11/1982 | Ariga et al. | 165/80 |
| 5,155,800 | A | * | 10/1992 | Rezabek et al. | 392/503 |
| 5,329,993 | A | | 7/1994 | Ettehadieh | 165/104.14 |
| 5,331,510 | A | | 7/1994 | Ouchi et al. | 361/702 |
| 5,409,055 | A | | 4/1995 | Tanaka et al. | 165/104.33 |
| 5,930,459 | A | * | 7/1999 | Eckman et al. | 392/503 |
| 6,058,012 | A | | 5/2000 | Cooper et al. | 361/704 |
| 6,102,110 | A | | 8/2000 | Julien et al. | 165/104.33 |
| 6,105,662 | A | | 8/2000 | Suzuki | 165/104.33 |

* cited by examiner

*Primary Examiner*—Thor Campbell
(74) *Attorney, Agent, or Firm*—Barlow, Joephs & Holmes, Ltd.

(57) ABSTRACT

An electric heater element, that is injection overmolded with a thermally conductive polymer having a thermal conductivity of at least 3 W/m° K, includes surface enhancements to increase the overall outer surface area of the element that is in contact with a fluid to be heated, thereby enhancing the efficiency of heat transfer into the fluid. The heater element has a solid core having a resistance heating element spirally wound about its outer surface. An outer covering is injection overmolded onto the core sealing the heating element and shielding it from the exterior environment. While the outer covering seals the heating element it also includes surface enhancements such as concentric fins, pins or discs that increase the contact surface area of the outer cover, further enhancing the heat transfer properties of the heating element. The outer cover is injection molded from a thermally conductive polymer material that has a coefficient of thermal expansion that is matched with that of the remaining materials to reduce the potential of thermal stress cracks during operation of the finished product. Further, the present invention includes the method of manufacturing the heating element as described herein.

11 Claims, 5 Drawing Sheets

RADIAL FIN THERMAL TRANSFER ELEMENT AND METHOD OF MANUFACTURING SAME

BACKGROUND OF THE INVENTION

The present invention relates to electric resistance heating elements. More particularly, the present invention relates to electric resistance heating elements for heating fluids such as gasses or liquids, where the heating element has an overmolded thermally conductive polymer coating, which includes integrally molded surface enhancements to increase the thermal transfer efficiency between the assembly and the fluid to be heated.

Electric resistance heating elements, such as those used in connection with water heaters, have traditionally been made from metallic and ceramic components. A typical prior art construction, for example, includes a pair of terminal pins brazed to the ends of a wound metallic coil element, which is then inserted axially through a U-shaped tubular metal sheath. The resistance coil is electrically insulated from the walls of the metal sheath by a powdered ceramic material, such as magnesium oxide. The entire assembly is then placed through an opening in the wall of a tank and sealed in place, leaving the U-shaped tube exposed on the interior of the tank to heat the fluid contained within the tank.

While such conventional heating elements have been commonly used as the primary heating element in the water heater industry for decades, there are a number of widely recognized deficiencies with this type of heating element. For example, because the entire system is generally surrounded by water during operation, galvanic currents occurring between the metal sheath of the element and any exposed metal surfaces in the tank can cause corrosion of the various anodic metal components of the system. The metal sheath of the heating element, which is typically formed from copper or copper alloy, also attracts lime deposits from the water, causing them to build up on the surface of the sheath, further contributing to premature failure of the heating element. Additionally, the use of brass and copper fittings and tubing has become increasingly more expensive as the price of copper has increased over the years.

In an attempt to overcome the deficiencies associated with the metal heating elements, a number of electric heating elements that include a plastic outer sheath have been developed in the prior art. In one application, the metallic tube sheath is simply replaced with a plastic sheath, which is used in conjunction with a conventional wound resistance wire coil and powdered magnesium oxide coating. Since the plastic sheath is non-conductive, there is no galvanic cell created between the element and the other metallic parts of the heating unit in contact with the water in the tank. Also, the use of a plastic sheath eliminates the possibility of lime buildup. Unfortunately, for various reasons, the prior art plastic-sheath heating elements are not capable of attaining sufficiently high wattage ratings over a normal useful service life and as a result, are not widely accepted.

Another prior art heating element includes a hollow tubular core around which a resistance heating element is wound. A thermally conductive polymer coating is then placed over the resistance element and tubular core to form a hermetic seal around the resistance wire. While this type of heating element can produce and withstand the required operational wattage range to be commercially acceptable, they also have several drawbacks. To enhance the transfer of heat to the fluid medium, the resistance heating element is formed as a hollow tube. This hollow tube design has the tendency, however, to trap pockets of air on the interior cavity of the tube that lead to overheating, burnout and eventual element failure. Further, the surface of the element that contacts the fluid medium is smooth, providing a reduced surface area for heat exchange between the heating element and the fluid medium. Finally, because the heating element is subjected to significant temperature changes in its normal range of operation, the material is subjected to a great deal of thermal stress in the form of thermal expansion. Since the polymer coating has a coefficient of thermal expansion (CTE) that is different than the CTE of the base tube and the resistance heating element, the various materials tend to expand and contract at different rates. This differential expansion produces mechanical stresses in the polymer coating that may result in cracking of the coating, thus allowing the fluid to leak into the element, which ultimately results in the failure of the element.

Another environment in which this type of heating element is encountered is in heating aquariums. In the prior art, aquarium heaters are manufactured as described above with a wound resistance heating element supported on a ceramic core, however, the outer casing is typically made from glass. The use of glass is necessary to insure that in the event that the heating element becomes electrically shorted, no electrical current will flow into the aquarium creating a potential hazard to any person encountering the aquarium. While in this case the glass provides an effective enclosure for the heating element, it is also relatively fragile and subject to breakage.

SUMMARY OF THE INVENTION

The present invention provides for an electric heater element that is injection overmolded with a thermally conductive polymer having a thermal conductivity of at least 3 W/m° K. In addition, the heater element of the present invention includes surface enhancements to increase the overall outer surface area of the element that is in contact with the fluid thereby enhancing the efficiency of heat transfer into the fluid.

In this regard, the instant invention includes a solid core heater element that can be used to replace the conventional heater elements described above while overcoming many of the deficiencies noted with respect to the prior art elements. Since the core of the heater element is solid, it does not have any voids that could potentially trap pockets of air that would cause hot spots on the surface of the heater element and eventual element failure. The solid core of the element is molded having channels in its outer surface where the resistance heating element is wound and supported. The resistance heating element is spirally wound starting at the base of the core in a circular fashion to the end of the core and is threaded back down a passage in the center of the core. In this manner, the resistance heating wire can be connected to two metallic pins at the base of the core to facilitate electrical connections once the element is completed and installed in a finished product.

Once the resistance heating element is wound around the core, the outer covering is injection overmolded onto the core sealing the heating element and shielding it from the exterior environment. While the outer covering seals the heating element, it also includes surface enhancements such as concentric fins, pins or discs that increase the contact surface area of the outer cover, further enhancing the heat transfer properties of the heating element. The outer cover is injection molded from a thermally conductive polymer material that includes a base polymer matrix and a thermally conductive filler loaded therein. Further, the polymer base matrix is selected in such a manner to match the CTE of the base material to the CTE of the rest of heating element to prevent CTE mismatches and the resulting cracking of the outer covering. After the overmolding is complete, the assembly is inserted into a base support to facilitate integration with the finished product such as a water heater.

Finally, it can be appreciated that the present invention also includes the method of manufacturing the present invention in accordance with the disclosure contained herein. The method of manufacture includes providing a central core element around which a resistance heating element is wound, injection overmolding a thermally conductive polymer coating over the core element and installing the assembly into a support base.

Therefore, it is an object of the present invention to provide a heating element that is hermetically sealed for use in heating fluids. It is a further object of the present invention to provide a heating element with an outer casing that includes integral elements for enhancing the surface area and thermal transfer efficiency of the heating element. It is yet another object of the present invention to provide a heating element with an outer casing that is resistant to cracking as a result of thermal expansion of the inner core or breaking due to droppage or rough handling.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
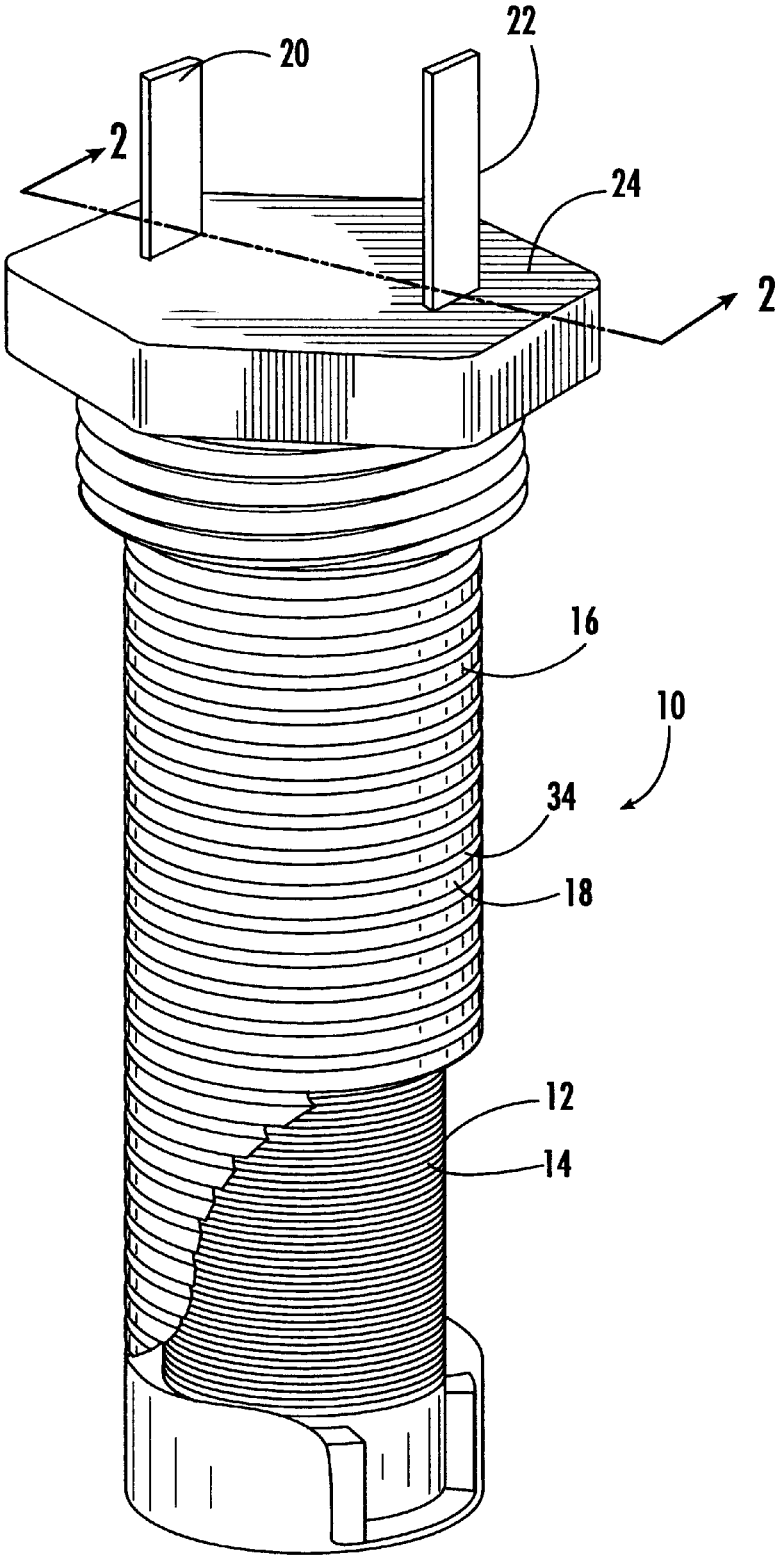
FIG. 1 is a partially cut away perspective view of the preferred embodiment of the heating element of the present invention.
Figure 3:
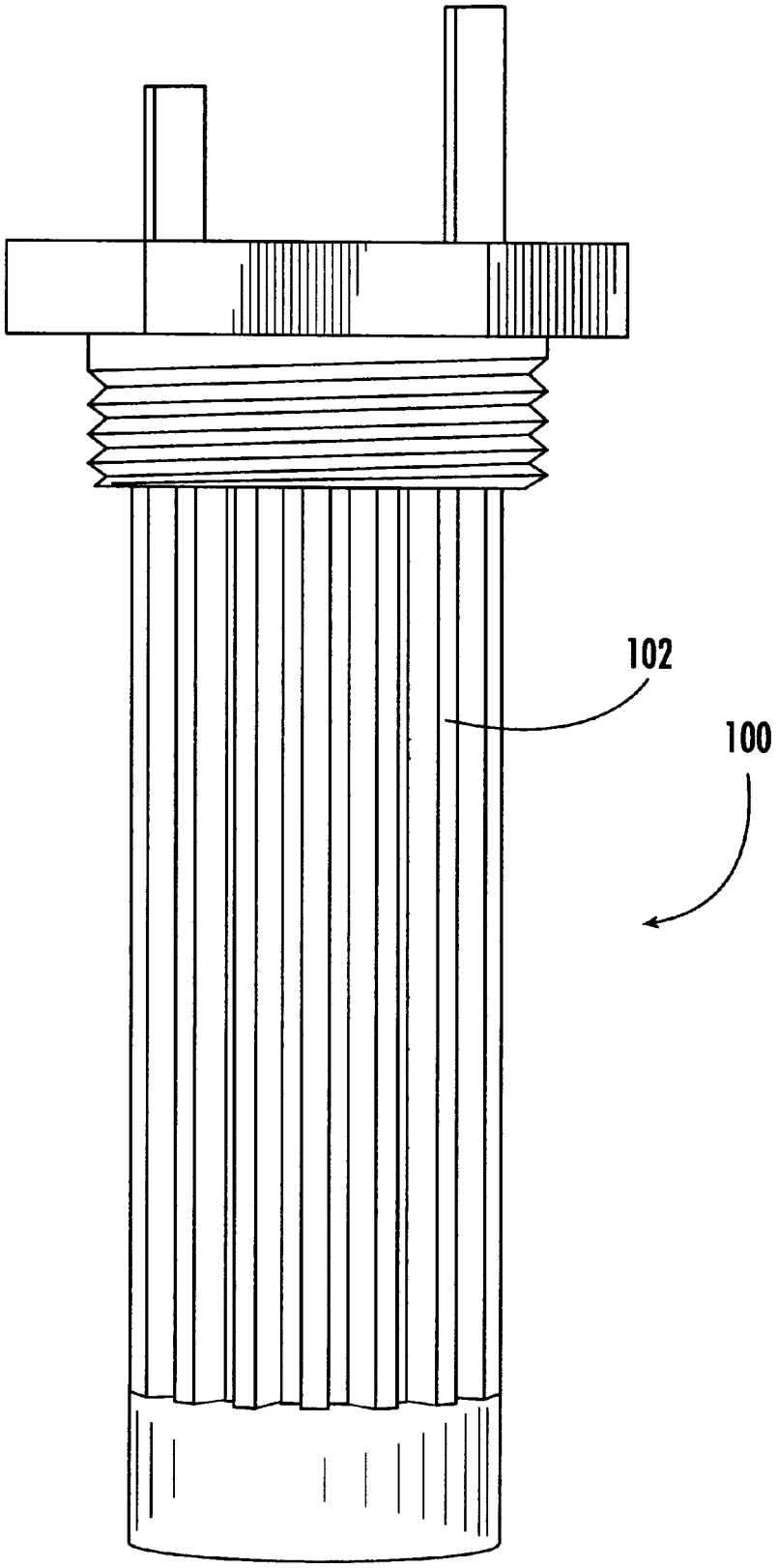
FIG. 3 is an elevational view of a first alternate embodiment of the heating element of the present invention.
Figure 4:
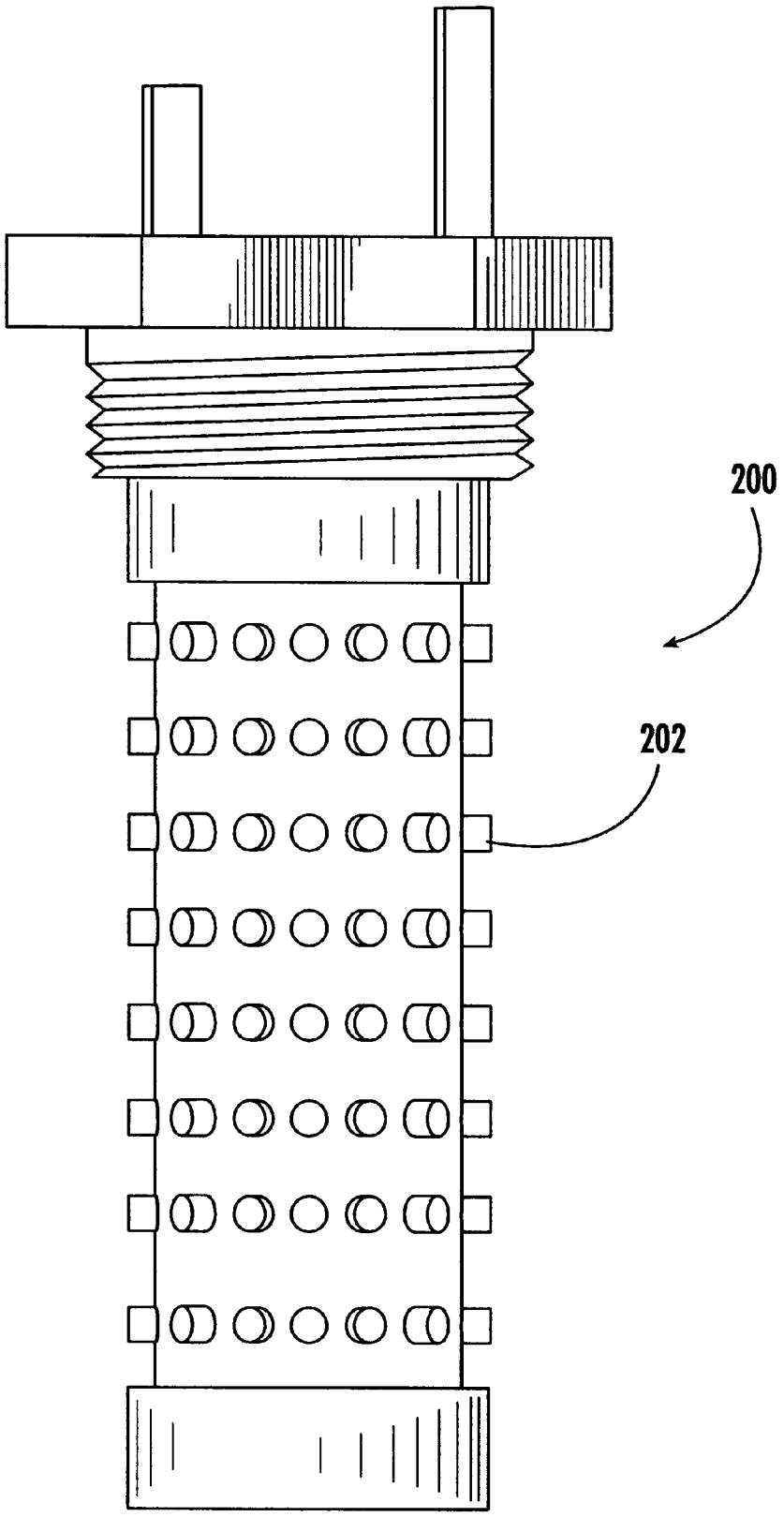
FIG. 4 is an elevational view of a second alternate embodiment of the heating element of the present invention.
Figure 5:
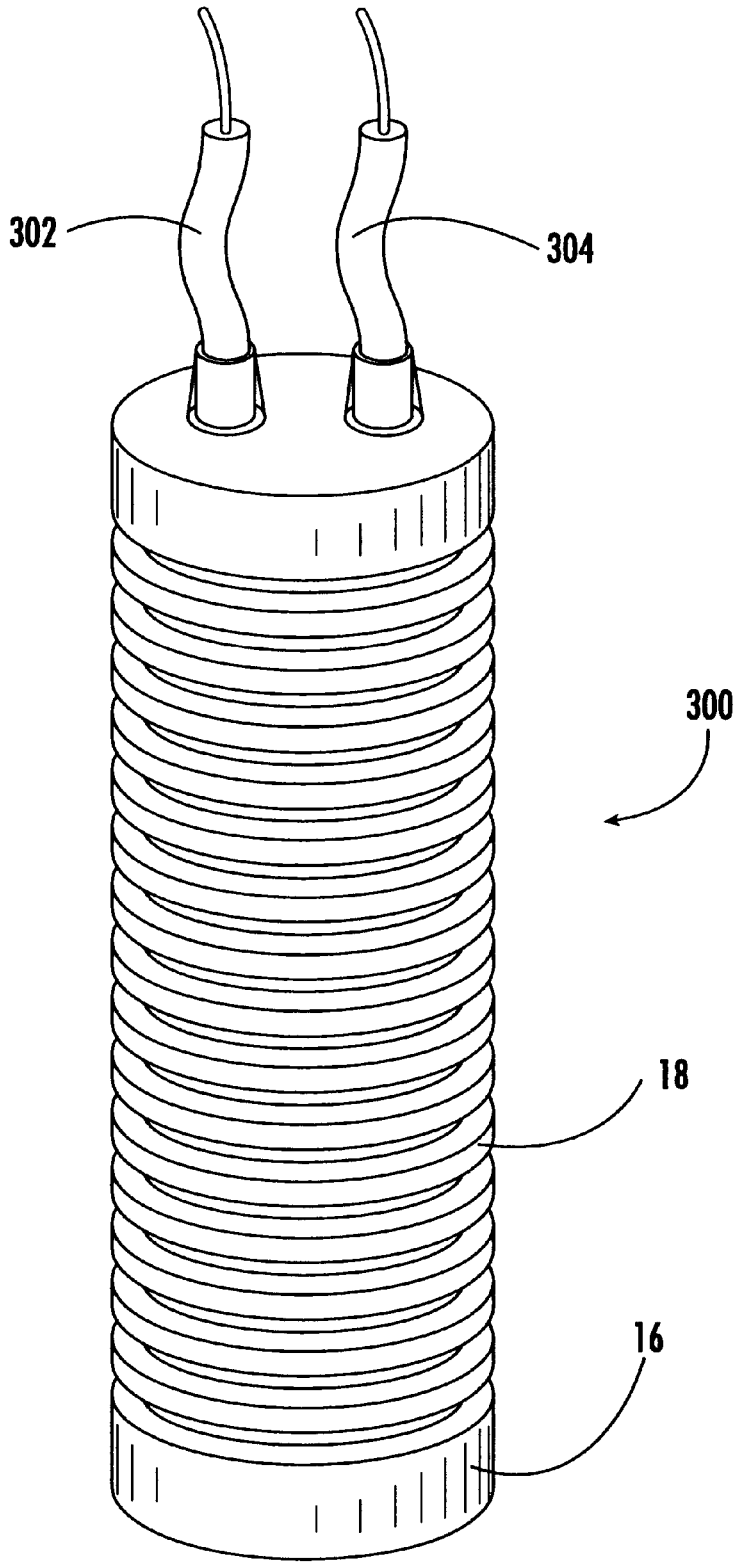
FIG. 5 is a perspective view of a third alternate embodiment of the heating element of the present invention.

Referring now to the drawings, electric resistance heater element of the present invention is illustrated and generally indicated at 10 in FIGS. 1 add 2. In addition, several alternate embodiments of the present invention are illustrated in FIGS. 3–5. As will hereinafter be more fully described, the instant invention is an electric resistance heating element 10 for use in a variety of applications, where the heating of a fluid medium is required. The heating element 10 of the present invention generally includes a solid core 12, a wound resistance heating wire 14, an injection molded outer cover 16 having surface enhancements such as fins 18, electrical contacts 20, 22 and a mounting cap 24.

Figure 2:
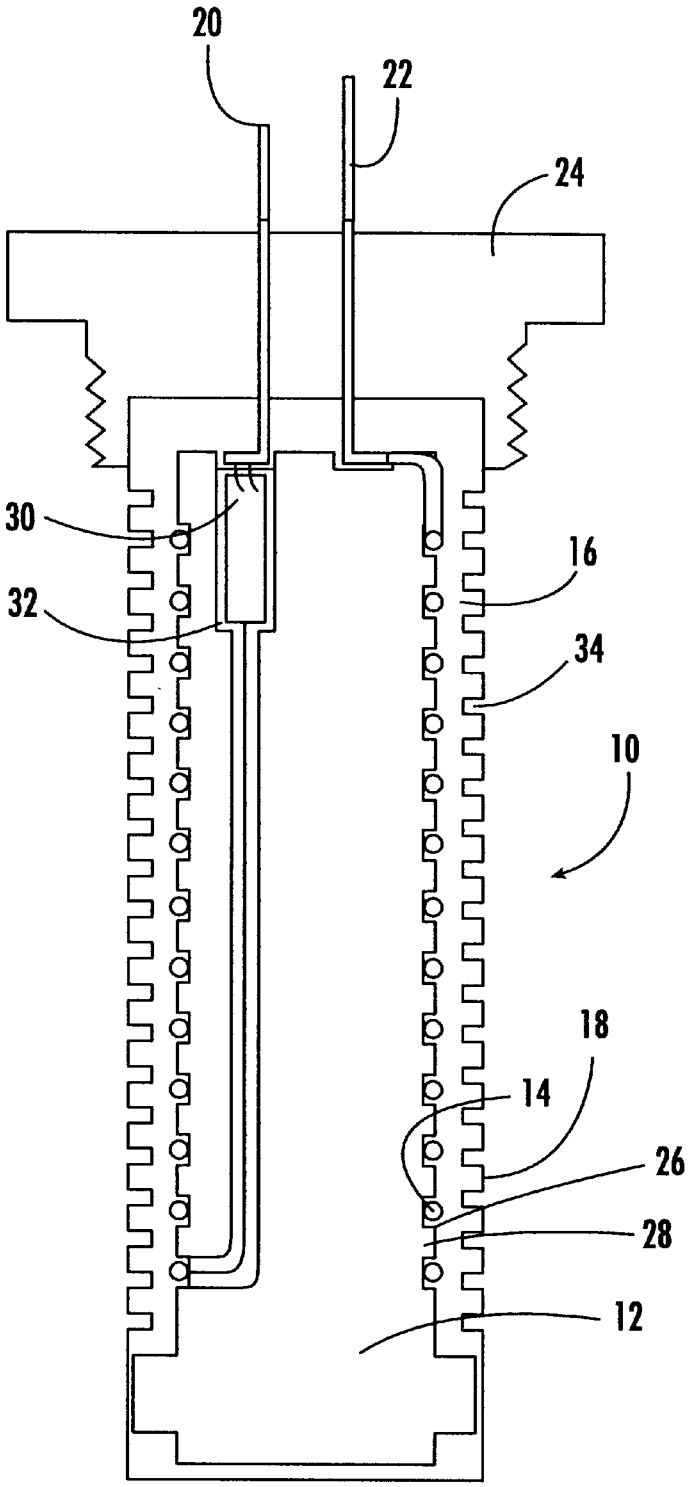
FIG. 2 is a cross sectional view thereof taken along line 2—2.

Turning to FIGS. 1 and 2, the preferred embodiment of the electric resistance heating element 10 is shown. At the center of the heating element 10 is a solid support core 12. The support core 12 is formed from a high temperature polymer material that is electrically resistive. The preferred material includes polymers that can withstand temperatures that are beyond the optimum operating range of the coil of between approximately 240° C. and 330° C. without significant deformation or melting. Preferable polymers for use in this application include liquid crystal polymer, PET, PPS and PEK. The core 12 is preferably formed by injection molding but other forming methods may be used. The outer surface of the core 12 has a recessed groove or channel 26 that proceeds in a continuous spiral fashion from one end of the core 12 to the opposite end. The channel 26 is sufficiently wide and deep to receive the resistance heating wire 14 therein. The resistance heating wire 14 is wound on the outer surface of the core 12 element in the channel 26 provided therein. The channel 26 as described above is provided in a continuous spiral to allow a continuous length of resistance wire 14 to be wound on the core 12 in the channel 26. When installed in this fashion, the resistance wire 14 is maintained in an even spacing along the length of the core 12 element and each successive winding of the resistance wire 14 is prevented from contacting the previous winding by the ridge 28 between the channels 26. By separating the successive windings of the resistance wire 14 in this fashion, each winding is electrically isolated from one another, preventing an unintentional short circuit from forming in the winding.

The resistance wire 14 is preferably a continuous length of conductive metallic material such as copper. The resistance wire 14 is used to conduct electrical current and generate heat in the electrical resistance heater 10 of the present invention, and preferably contains a resistance metal that is electrically conductive and heat resistant. A prefered metal in this application is Ni—Cr alloy although certain copper, steel and stainless-steel alloys may also be suitable. In addition, certain conductive polymers, containing graphite, carbon or metal powders or fibers, for example, can be used as a substitute for the metallic resistance material, so long as they are capable of generating sufficient resistance heating to heat fluids, such as water. A continuous length of resistance wire 14 is wound in such a fashion as to allow both free ends of the wire to be further connected to electrical contact pins 20, 22 at one end of the core element 12. The contact pins 20, 22 are then further connected to a power source and control device (not shown) to complete the electrical circuit. Such a power source and control device need not be discussed herein as they are well known in the art. In this fashion, the electricity can enter one contact pin 20 and be conducted through the electrical resistance wire 14 and to the second contact pin 22, thereby energizing the resistance wire 14 and generating heat. The present invention may further contain rudimentary control circuitry 30 provided in a small cavity 32 in the core element 12, such as thermal overload protection in the form of a thermistor 30. Alternately, the thermistor 30 can be replaced with a thermostat, a solid-state TCO or merely a grounding band that is connected to an external circuit breaker (not shown).

The outer cover 16 of the heating element 10 of the present invention is formed preferably by net-shape insert injection molding, although other forming methods may be used. An advantage in the present invention is the fact that it is net shape moldable, meaning, the part that is created in the injection molding process does not require any further processing steps after it is removed from the mold and before it is incorporated into the finished device. Net-shape moldability is distinct advantage over the prior art where parts had to be machined in several steps to achieve the desired part geometry. The preferred embodiment of the outer cover 16 of the present invention is formed from a base polymer matrix with a thermally conductive filler material loaded therein. The base polymer matrix is preferably an elastomer while the preferred filler material is boron nitride but may also include alumina, metallic flakes, carbon powder, crushed glass or mixtures thereof. Elastomer is used as a base polymer matrix because it provides two distinct advantages over the prior art. The first advantage is that the elastomer material allows the cover 16 of the present invention to be more resistant to mismatches in the coefficients of thermal expansion (CTE's) of the various materials used in the resistance heating element 10. For example, the central core 12 is formed from a high temperature polymer matrix while the resistance wire 14 is metallic and the outer cover 16 is yet a third material. Each one of these elements, formed from a different material, has a different CTE, resulting in different rates of material expansion under varying thermal loads. When in operation, the heating element 10 of the present invention may be subjected to temperatures anywhere between 240° C. and 330° C. As a result, the materials used to make the resistance heating element 10 will expand and contract at different rates. In the prior art, the material used to form the cover would often crack if the differential expansion between the core and the outer covering was too great. In order to overcome this drawback in the prior art, the present invention employs an elastomer as a base polymer matrix. While the CTE of the elastomer material may not match the CTE of the other materials used in constructing the resistance heating element 10, the elastomer has a large modulus of elasticity that allows it to expand and contract as necessary to accommodate the thermal expansion of the materials contained therein.

Another advantage associated with the use of elastomer for an outer cover 16 is that the material is pliable in contrast to the brittle materials used in the prior art. Generally, this type of heating element 10 is subjected to rough handling during removal and replacement of the part. If the outer covering 16 is formed from a brittle polymer material, as in the prior art, portions of the outer cover may become chipped or even cracked if the heating element 10 is dropped or receives an impact against a hard surface. By using an elastomer material, the outer covering 16 is pliable and therefore resistant to damage from dropping or shocks.

The outer surface of the outer covering 16 includes integrally formed fins 18. In the preferred embodiment, shown in FIGS. 1 and 2, the fins 18 are generally circumferential flanges around the entire circumference of the outer surface of heating element 10. This configuration of the fins is an important feature of the present invention. When installed into a water heater, the heating element 10 of the present invention is generally placed in a horizontal orientation and secured in place. As can be understood, the fluid to be heated will contact the outer surface 16 of the heating element 10 and tend to rise due to convective effects that are well known in the art. By orienting the fins 18 in the disk fashion shown, when the heating element 10 is in operative position, vertically aligned channels 34 are formed that allow the free convective flow of the fluid around and past the outer surface 16 of the present invention. Further, as the fluid is subjected to heating and cooling, air bubbles that were previously dissolved in the water may be released. The fins 18 of the present invention are oriented in such a manner as to allow these bubbles to rise past the outer surface 16 of the heating element 10 without trapping them. As was discussed earlier, in the prior art, trapped air may lead to hot spots and failure of the element. Finally, it can be seen that by providing the fins 18 on the outer surface of the outer covering 16 the overall contact surface area of the heating element 10, available for transferring heat into the fluid medium, is greatly increased over a similar element having a smooth surface. The increase in surface area provides an increase in operating efficiency of the overall device.

Turning to FIGS. 3 and 4 first and second alternative embodiments of the heating element of the present invention are shown. In FIG. 3 a heating element 100 having fins 102 on the outer surface of the outer covering 16 are shown in a longitudinal orientation. This orientation is provided for use in devices where the required operating orientation of the heating element 100 is vertical. Further FIG. 4 shows a heating element 200 where pins 202 are used as the surface enhancements on the outer surface of the outer covering 16. Each of the configurations shown may be employed to tailor the efficiency of the heating element to the required application and in order to enhance the convective flow of the fluid around the heating element.

Finally, turning to FIG. 5 a third alternate embodiment of the present invention is shown. The resistance heating element 300 in this case is designed for stand alone use such as in a fish tank heater. The invention includes a central core 12 and resistance heating wire 14 as described above, however, the contact pins 20, 22 are replaced with wire leads 302, 304 for direct connection to a power source or to some form of additional housing and control circuit (not shown). The outer cover 16 is injection molded, again using an elastomer material loaded with thermally conductive filler, over the entire outer surface of the core 12, resistance wire and wire leads 302, 304. In this fashion, the entire device is sealed against infiltration of fluid and is suitable for use in environments where complete immersion in the fluid is required. The orientation of the surface enhancements 18 on the outer surface of the outer cover 16 are tailored as described above to enhance the efficiency of the device relative to the operational orientation in which the device will be installed.

In addition to the end product, the present invention includes the process by which the product is made. Namely, the process includes first providing a central core 12 element around which a resistance heating wire 14 is wound. Next, the ends of the wire to terminal posts 20, 22 are connected to the end of the core 12. Finally, the outer cover 16 is net shape injection molded over the central core 12 and wire 14 that includes integrally formed surface area enhancements 18.

The present invention is described in connection with use for heating a liquid. It should also be understood that the construction of the heat transfer element can also be used for cooling liquids into which it is placed. In this use, (not shown) the resistance heating wire 14 is replaced with an appropriate cooling component.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An electrical resistance heating element for heating a fluid medium, comprising:

a solid central core having an outer surface and an interface end;

a resistance wire, having a first end and a second end, spirally wound onto said outer surface of said central core wherein said first and second ends are respectively connected to first and second terminal leads mounted to said interface end of said central core; and a thermally conductive polymer composition having an outer thermal interface surface; said composition encapsulated about said resistance wire and said outer surface of said central core, thereby encapsulating and electrically insulating said resistance wire from said fluid medium; said polymer coating including a elastomeric base matrix and a thermally conductive filler loaded therein; said outer thermal interface surface having integrally formed thermal transfer fins to increase its surface area.

2. The electrical resistance heating element of claim 1, wherein said thermally conductive filler is selected from the group consisting of: alumina, boron nitride, metallic flakes, carbon powder, crushed glass and mixtures thereof.

3. The electrical resistance heating element of claim 1, wherein said thermal transfer fins on said outer thermal interface surface are radially arranged fins disposed on said outer thermal interface surface.

4. The electrical resistance heating element of claim 1, wherein said thermal transfer fins on said outer thermal interface surface are longitudinally arranged fins disposed on said outer thermal interface surface.

5. The electrical resistance heating element of claim 1, wherein said polymer coating has a thermal conductivity of at least 3 W/m° K.

6. An electrical resistance heating element for heating a fluid medium, comprising:

a solid central polymer core having an interface end, an inactive end and an outer surface with a channel spirally extending around said outer surface between said interface end and said inactive end;

first and second terminal leads mounted to said interface end of said central core;

a resistance wire having a first end and a second end, disposed within said channel in said outer surface of said central core wherein said first and second ends are respectively connected to said first and second terminal leads; and a thermally conductive elastomeric composition having an outer thermal interface surface, said composition being positioned about said resistance wire and said outer surface of said central core, thereby encapsulating and electrically insulating said resistance wire from said fluid medium; said polymer coating including an elastomeric polymer base matrix and a thermally conductive filler loaded therein; said outer thermal interface surface having an array of integrally formed thermal transfer fins to increase its surface area.

7. A method of manufacturing an electrical resistance heating element for heating a fluid medium, comprising:

providing a solid central core having an outer surface and an interface end;

mounting first and second terminal leads to said interface end of said central core;

winding a resistance wire having a first end and a second end, in a spiral fashion onto said outer surface of said central core;

respectively connecting said first and second ends of said resistance wire to said first and second terminal leads;

injection molding a thermally conductive elastomeric composition, having an outer thermal interface surface, over and about said resistance wire and said outer surface of said central core, thereby encapsulating and electrically insulating said resistance wire from said fluid medium; said polymer coating including an elastomeric base matrix and a thermally conductive filler loaded therein; and providing integrally molded thermal transfer fins in said outer thermal interface surface.

8. A method of manufacturing an electrical resistance heating element of claim 7, wherein said thermally conductive filler is selected from the group consisting of: alumina, boron nitride, metallic flakes, carbon powder, crushed glass or mixtures thereof.

9. A method of manufacturing an electrical resistance heating element of claim 7, wherein said thermal transfer fins on said outer thermal interface surface are radial fins disposed on said outer thermal interface surface.

10. A method of manufacturing an electrical resistance heating element of claim 7, wherein said thermal transfer fins on said outer thermal interface surface are longitudinal fins disposed on said outer thermal interface surface.

11. A method of manufacturing an electrical resistance heating element of claim 7, wherein said polymer coating has a thermal conductivity of at least 3 W/m° K.

* * * * *